US010109956B2

(12) United States Patent
Ju

(10) Patent No.: US 10,109,956 B2
(45) Date of Patent: Oct. 23, 2018

(54) ELECTRICAL CONNECTOR HAVING HIGH FREQUENCY PERFORMANCE AND SHORTENED OVERALL LENGTH

(71) Applicant: LOTES CO., LTD, Keelung (TW)

(72) Inventor: Ted Ju, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 15/697,989

(22) Filed: Sep. 7, 2017

(65) Prior Publication Data

US 2018/0097310 A1 Apr. 5, 2018

Related U.S. Application Data

(60) Provisional application No. 62/404,395, filed on Oct. 5, 2016.

(30) Foreign Application Priority Data

Jan. 9, 2017 (CN) ..... 2017 2 0019539 U

(51) Int. Cl.
*H01R 13/648* (2006.01)
*H01R 13/646* (2011.01)
(Continued)

(52) U.S. Cl.
CPC ..... *H01R 13/646* (2013.01); *H01R 9/03* (2013.01); *H01R 13/04* (2013.01); *H01R 13/20* (2013.01);
(Continued)

(58) Field of Classification Search
CPC ..... H01R 23/02; H01R 24/60; H01R 24/62; H01R 13/6587; H01R 13/6594;
(Continued)

(56) References Cited

U.S. PATENT DOCUMENTS 9,385,481 B2 * 7/2016 Chung ..... H01R 24/60
9,912,086 B2 * 3/2018 Guo ..... H01R 12/716
(Continued)

FOREIGN PATENT DOCUMENTS

CN 102237592 A 11/2011
CN 105098529 A 11/2015
(Continued)

*Primary Examiner* — Hae Moon Hyeon
(74) *Attorney, Agent, or Firm* — Locke Lord LLP; Tim Tingkang Xia, Esq.

(57) ABSTRACT

An electrical connector includes an insulating body, and a first terminal group and a second terminal group arranged at the insulating body. The first terminal group has one pair of first signal terminals, and each signal terminal has a first signal leg exposed out of the insulating body. The second terminal group has a second ground terminal and a second power terminal, and the second ground terminal and the second power terminal correspondingly having a second grounding leg and a second power leg exposed out of the insulating body. The second grounding leg, the second power leg and the first signal leg are arranged in a row, and the second grounding leg and the second power leg are provided with only one pair of first signal legs therebetween.

20 Claims, 8 Drawing Sheets

(51) Int. Cl.

| | |
|---|---|
| ***H01R 13/04*** | (2006.01) |
| ***H01R 13/652*** | (2006.01) |
| ***H01R 13/6581*** | (2011.01) |
| ***H01R 24/60*** | (2011.01) |
| ***H01R 13/20*** | (2006.01) |
| ***H01R 13/6591*** | (2011.01) |
| ***H01R 9/03*** | (2006.01) |
| ***H01R 13/405*** | (2006.01) |
| ***H01R 13/631*** | (2006.01) |
| ***H01R 13/6594*** | (2011.01) |
| ***H01R 13/6597*** | (2011.01) |
| ***H01R 43/02*** | (2006.01) |

(52) U.S. Cl.

CPC ..... *H01R 13/405* (2013.01); *H01R 13/631* (2013.01); *H01R 13/6485* (2013.01); *H01R 13/652* (2013.01); *H01R 13/6581* (2013.01); *H01R 13/6591* (2013.01); *H01R 13/6594* (2013.01); *H01R 13/6597* (2013.01); *H01R 24/60* (2013.01); *H01R 43/0256* (2013.01)

(58) Field of Classification Search

CPC ..... H01R 23/6873; H01R 23/7073; H01R 13/648; H01R 13/6581

USPC ..... 439/660, 676, 607.01, 607.4

See application file for complete search history.

(56) References Cited

U.S. PATENT DOCUMENTS

| | | | | |
|---|---|---|---|---|
| 2009/0017693 | A1* | 1/2009 | Nagata | H01R 12/724 439/660 |
| 2015/0340791 | A1* | 11/2015 | Kao | H01R 24/60 439/676 |
| 2016/0352052 | A1* | 12/2016 | Yu | H01R 13/6585 |
| 2017/0047674 | A1* | 2/2017 | Tsai | H01R 12/716 |

FOREIGN PATENT DOCUMENTS

| | | | |
|---|---|---|---|
| CN | 105428854 | A | 3/2016 |
| CN | 205282692 | U | 6/2016 |
| TW | M327579 | U | 2/2008 |

* cited by examiner

ELECTRICAL CONNECTOR HAVING HIGH FREQUENCY PERFORMANCE AND SHORTENED OVERALL LENGTH

CROSS-REFERENCE TO RELATED APPLICATION

This application claims priority and the benefit of U.S. Provisional Application No. 62/404,395, filed on Oct. 5, 2016, the entire contents of which are hereby incorporated by reference.

FIELD OF THE INVENTION

The present invention relates to an electrical connector, and more particularly to an electrical connector suitable for a universal serial bus port.

BACKGROUND OF THE INVENTION

With the development of the society, electronic devices are prone to the downsizing development; and meanwhile, higher signal rate transmission is also a tendency, so that a miniaturized electrical connector for a higher transmission rate is desirable at present.

A known electrical connector includes an insulating body and multiple terminals received at the insulating body. The terminals are arranged in an upper row and a lower row at the insulating body. Signal terminals in the upper row of terminals and the lower row of terminals are arranged correspondingly one above the other, and the upper row and the lower row are respectively provided with multiple pairs of signal terminals. Legs of the upper row of terminals are arranged in a row and are surface soldering legs, and legs of the lower row of terminals are perforated legs. When the legs are soldered to a circuit board, connection points on the circuit board are correspondingly connected with the legs of the upper row and lower row of terminals, a reasonable space is needed among the connection points of the circuit board corresponding to the perforated legs, and a greater space is desirable among the perforated legs, these perforated legs should be arranged in a front row and a rear row to satisfy the space demand among the legs of the lower row of terminals, thus resulting in relatively long length of the upper row of terminals and relatively long length of terminals in one row arranged adjacent to the legs of the upper row of terminals in the lower row of terminals, so that the upper row of terminals and part of terminals in the lower row are relatively high in impedance and relatively poor in high frequency performance, and the electrical connector is relatively long in overall length in the front-rear direction.

Therefore, a heretofore unaddressed need exists in the art to address the aforementioned deficiencies and inadequacies.

SUMMARY OF THE INVENTION

In one aspect, the present invention relates to an electrical connector that has improved high frequency performance and shortened overall length.

In certain embodiments, an electrical connector includes an insulating body and a first terminal group and a second terminal group disposed at the insulating body. The first terminal group has at least one pair of first signal terminals. Each of the signal terminals has a first signal leg exposed out of the insulating body. The second terminal group has a second ground terminal and a second power terminal. The second ground terminal has a second grounding leg exposed out of the insulating body, and the second power terminal has a second power leg exposed out of the insulating body. The first signal legs, the second grounding leg and the second power leg are arranged in a row, and the second grounding leg and the second power leg is provided with only one pair of first signal legs therebetween.

In certain embodiments, the first terminal group further has a first ground terminal and a first power terminal. The first ground terminal has a first grounding leg exposed out of the insulating body, and the first power terminal has a first power leg exposed out of the insulating body.

In certain embodiments, the electrical connector is used for being installed at a circuit board. The circuit board has at least one first solder pad. The first power leg and the second power leg are arranged adjacent to each other, and the first power leg and the second power leg are connected with the same first solder pad.

In certain embodiments, both the first power leg and the second power leg are surface soldering legs.

In certain embodiments, the first power leg is a surface soldering leg, and the second power leg is a perforated leg.

In certain embodiments, the first grounding leg, the second grounding leg, the first power leg, the second power leg and the first signal legs are arranged in a row.

In certain embodiments, the first signal legs are arranged between the first grounding leg and the first power leg.

In certain embodiments, the second grounding leg and the second power leg are disposed between the first grounding leg and the first power leg.

In certain embodiments, the first terminal group further comprises a reserved terminal. The reserved terminal has a first reserved leg exposed out of the insulating body. The first reserved leg and the first power leg are disposed at two opposite sides of the second power leg. A space between the first reserved leg and the second power leg is greater than a space between the first power leg and the first signal leg adjacent thereto.

In certain embodiments, the electrical connector is used for being installed at a circuit board. The circuit board has at least one second solder pad. The first grounding leg and the second grounding leg are arranged adjacent to each other, and the first grounding leg and the second grounding leg are connected with the same second solder pad.

In certain embodiments, both the first grounding leg and the second grounding leg are surface soldering legs.

In certain embodiments, the first grounding leg is a surface soldering leg, and the second grounding leg is a perforated leg.

In certain embodiments, the insulating body has a base and a tongue arranged in front of the base. The tongue has a first surface and a second surface disposed opposite to each other. The first signal terminal has a first contact portion exposed at the first surface, and both the second ground terminal and the second power terminal have second contact portions exposed at the second surface.

In certain embodiments, the electrical connector further includes a shielding sheet and a metal shell. The shielding sheet is disposed between the first terminal group and the second terminal group. The metal shell is disposed on the periphery of the insulating body. At least one side of the shielding sheet protrudes out of the base to form a grounding sheet, and the grounding sheet contacts the metal shell.

In certain embodiments, the second terminal group further has at least one pair of second signal terminals. Each of the second signal terminals has a second signal leg exposed out of the insulating body. Multiple second signal legs are arranged in a row, and the multiple second signal legs and the first signal leg are arranged at intervals in the front-rear direction.

In certain embodiments, the number of both the first and second ground terminals and the first and second power terminals is two, two pairs of first signal terminals are provided, the first and second ground terminals and the first and second power terminals and the first signal terminals are arranged at the insulating body in a bilaterally symmetric manner.

In certain embodiments, the first and second ground terminals, the first and second power terminals and the first signal terminals disposed at the same side of the insulating body respectively have a deflection portion, so that the first and second grounding legs, the first and second power legs and the first signal legs at the same side are relatively deflected outward in the left-right direction.

In certain embodiments, the first terminal group has multiple first legs exposed out of the insulating body, the multiple first legs are surface soldering legs and are arranged in a row. The second terminal group has multiple second legs exposed out of the insulating body, the multiple second legs are arranged in two rows in the front-rear direction. The second legs in one row are surface soldering legs and are disposed in a same row with the multiple first legs, and the second legs in the other row are perforated legs.

In certain embodiments, the first terminal group has multiple first legs exposed out of the insulating body, the multiple first legs are surface soldering legs and are arranged in a row, the second terminal group has multiple second legs exposed out of the insulating body, the multiple second legs are perforated legs and are arranged in two rows in the front-rear direction, and the second legs in one row are disposed in a same row with the multiple first legs.

In certain embodiments, the insulating body has a base and a tongue arranged in front of the base. The tongue has a first surface and a second surface disposed opposite to each other. The first terminal group is provided with multiple first contact portions disposed at the first surface, and the second terminal group is provided with multiple second contact portions disposed at the second surface. The first and second contact portions are respectively arranged successively with definitions of grounding, signal, signal, power, reserved, signal, signal, reserved, power, signal, signal and grounding, and the multiple first contact portions and the multiple second contact portions are in 180-degree symmetry about a center point of the tongue.

Compared with the related art, in certain embodiments of the present invention, the second power legs and the second grounding legs in the second terminal group and the first signal legs in the first terminal group are arranged in a row, so that some legs in the first and second terminal groups can be integrally arranged in one row, the number of the rows of the legs in the first and second terminal groups is reduced, thereby shortening a length of the terminals in the first terminal group and the length of part of the terminals in the second terminal group, reducing the impedance of the terminals in the first terminal group and the impedance of part of the terminals in the second terminal group, achieving relatively good high frequency performance of the electrical connector, and shortening the overall length of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
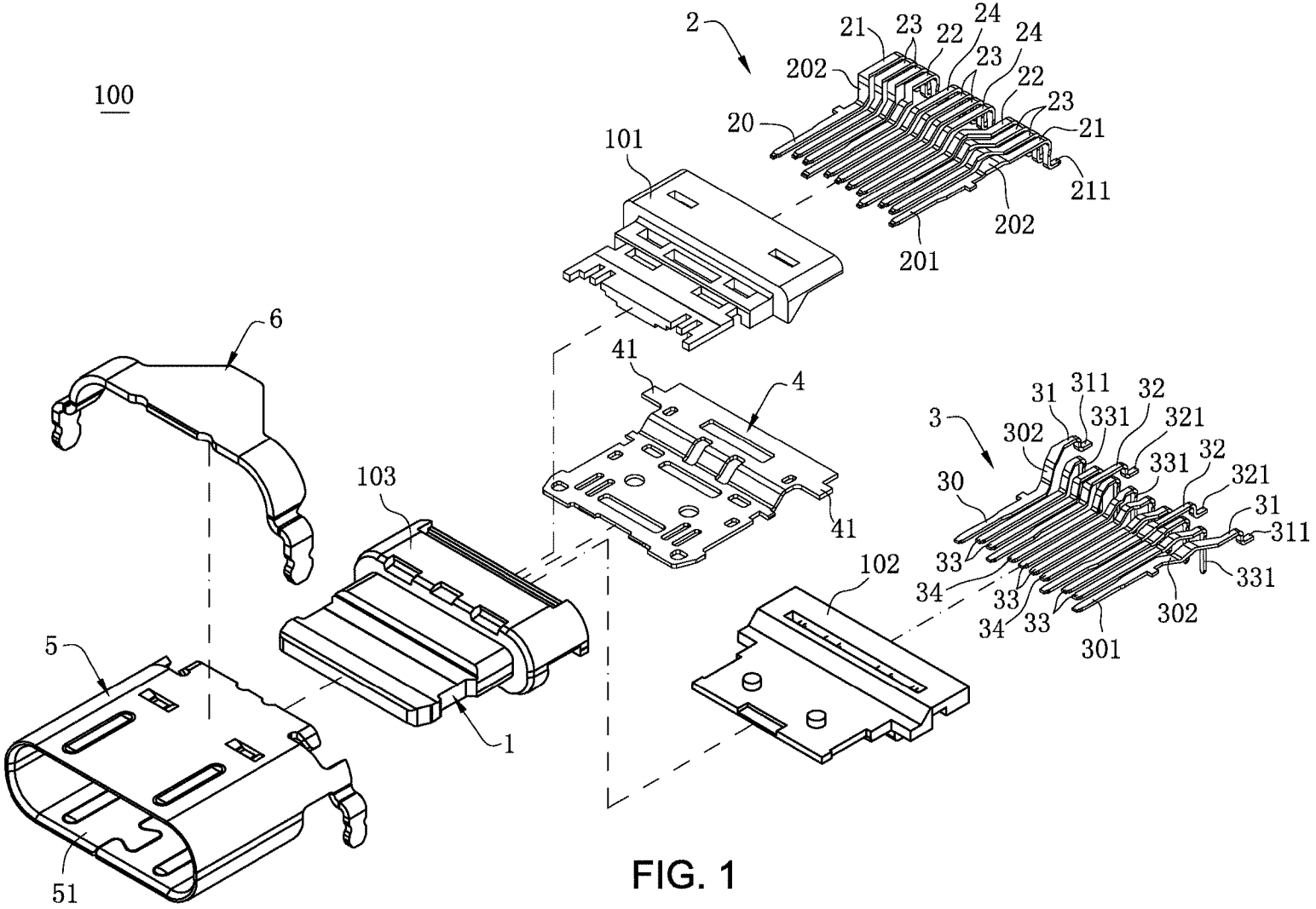
FIG. 1 is a schematic three-dimensional exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 4:
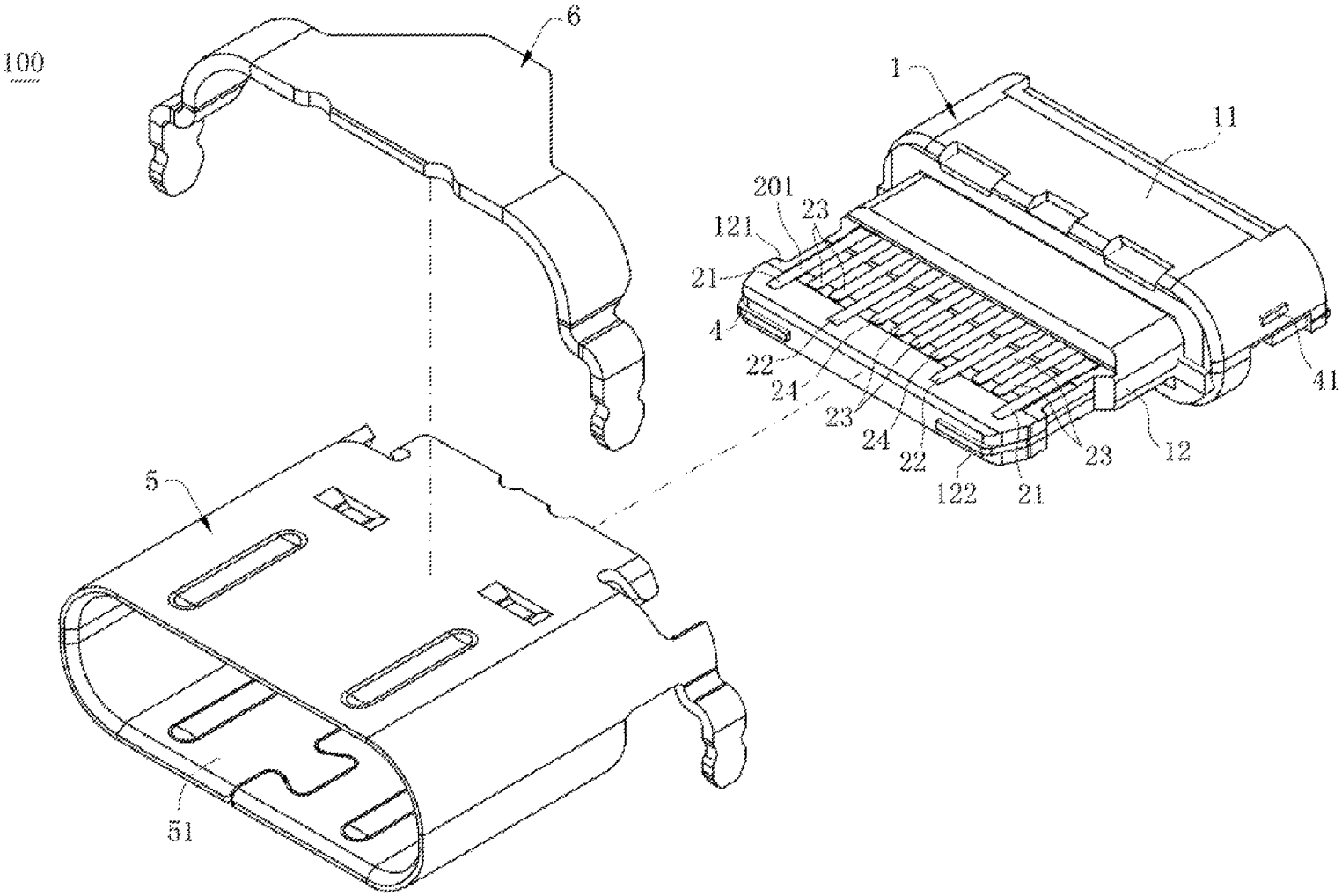
FIG. 4 is a schematic three-dimension view of FIG. 3, where an insulating wrapping body is injection molded outside the upper seat and the lower seat.
Figure 5:
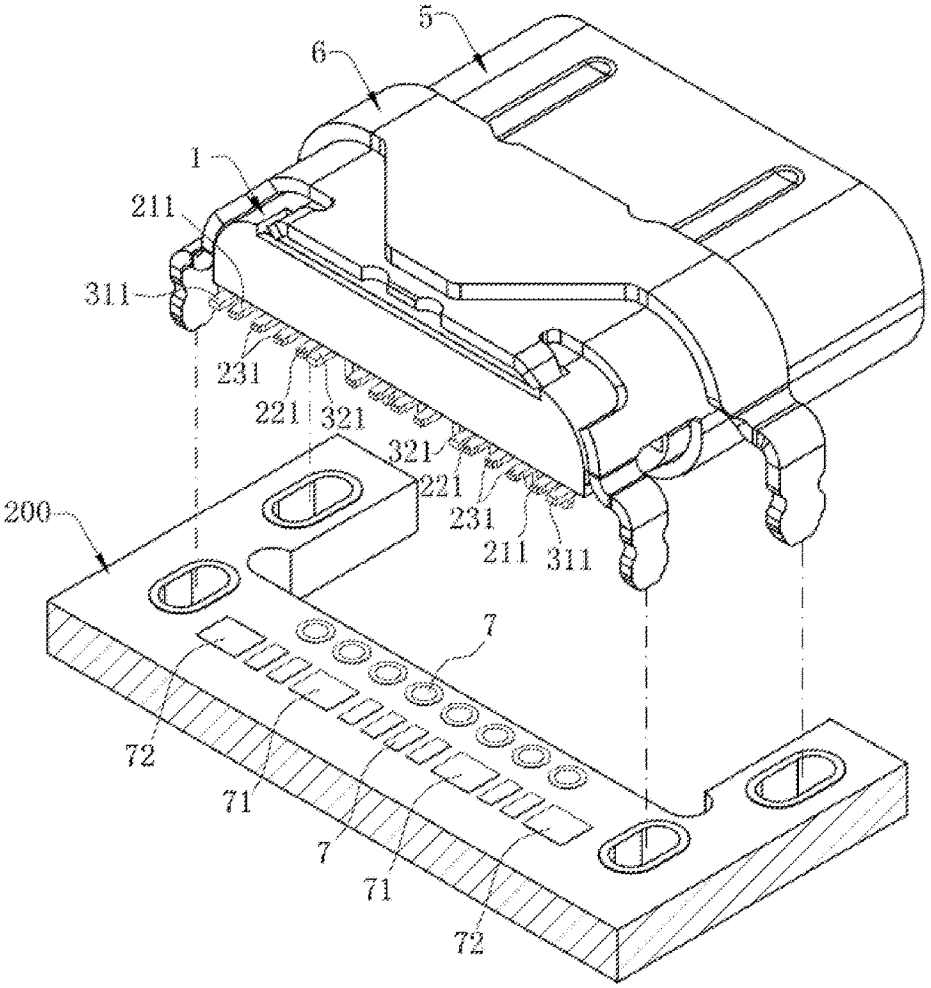
FIG. 5 is a schematic three-dimensional view of the first embodiment of the electrical connector, before the electrical connector is installed on a circuit board.

FIGS. 1, 4 and 5 show a first embodiment of an electrical connector 100 according to the present invention. The electrical connector 100 is of a sinking plate type and is used for being installed at a circuit board 200. The electrical connector 100 includes an insulating body 1, a first terminal group 2 and a second terminal group 3 disposed at the insulating body 1, a shielding sheet 4 disposed between the first terminal group 2 and the second terminal group 3, a metal shell 5 wrapping the insulating body 1 and a metal fixing member 6 retained outside the metal shell 5.

Figure 3:
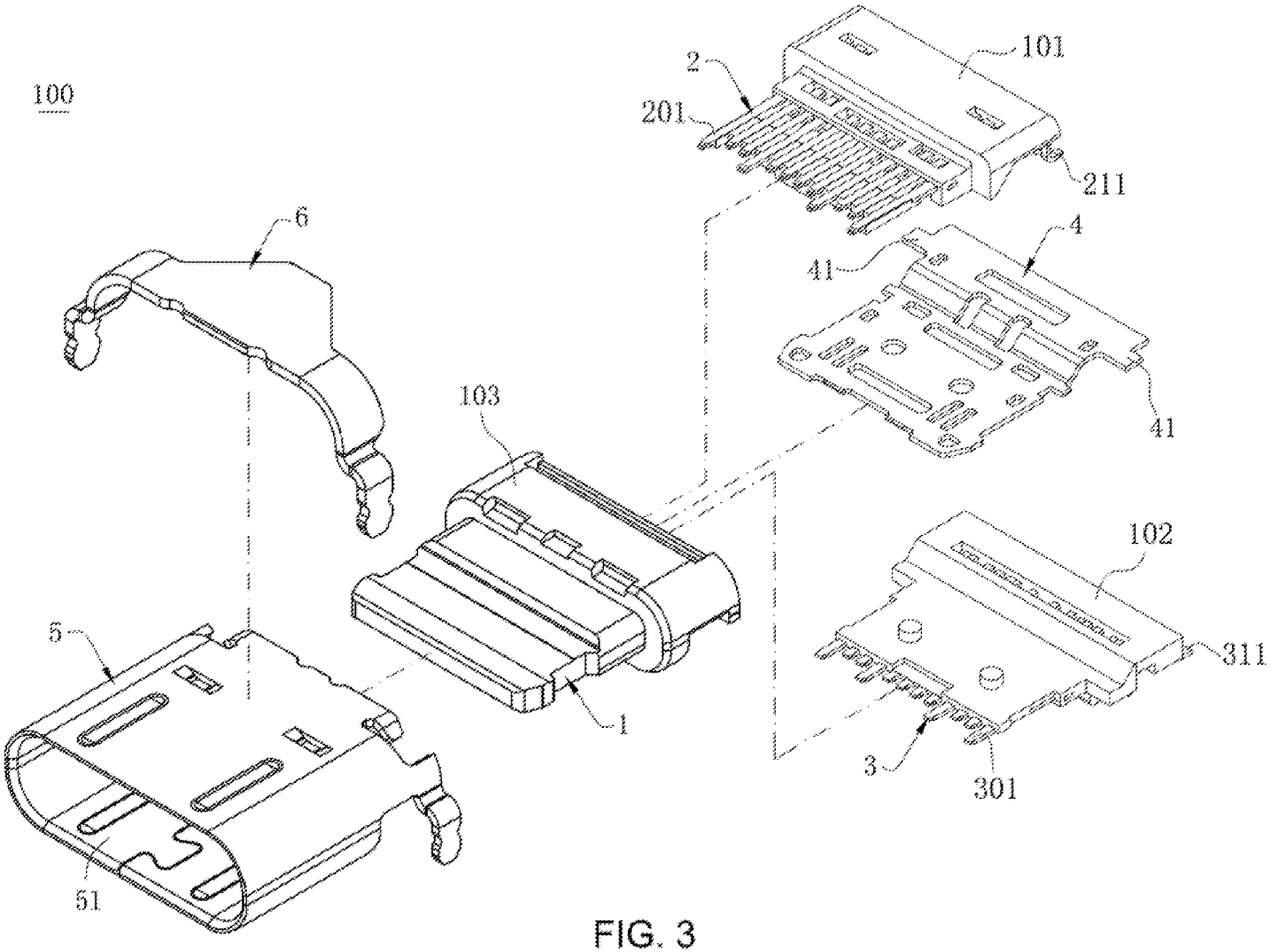
FIG. 3 is a schematic three-dimensional view of FIG. 1, where a first terminal group and a second terminal group are respectively injection molded at an upper seat and a lower seat.

Referring to FIGS. 1, 3 and 4, the insulating body 1 has a base 11 and a tongue 12 extending forward from the base 11. The tongue 12 has a first surface 121 and a second surface 122 disposed opposite to each other. The first surface 121 is disposed above the tongue 12, and the second surface 122 is disposed below the tongue 12. The insulating body 1 includes an upper seat 101 and a lower seat 102. The first terminal group 2 is insert molded at the upper seat 101. Two ends of each terminal in the first terminal group 2 are respectively exposed out of the upper seat 101. The second terminal group 3 is insert molded at the lower seat 102. Two ends of each terminal in the second terminal group 3 are respectively exposed out of the lower seat 102. The shielding sheet 4 is installed between the upper seat 101 and the lower seat 102, so that the shielding sheet 4 is disposed between the first terminal group 2 and the second terminal group 3 and performs the shielding between the two terminal groups. The upper seat 101 and the lower seat 102 are buckled with each other, then an insulating wrapping body 103 is injection molded outside the upper seat 101 and the lower seat 102, so that the upper seat 101, the lower seat 102 and the insulating wrapping body 103 form the base 11 and the tongue 12.

Figure 6:
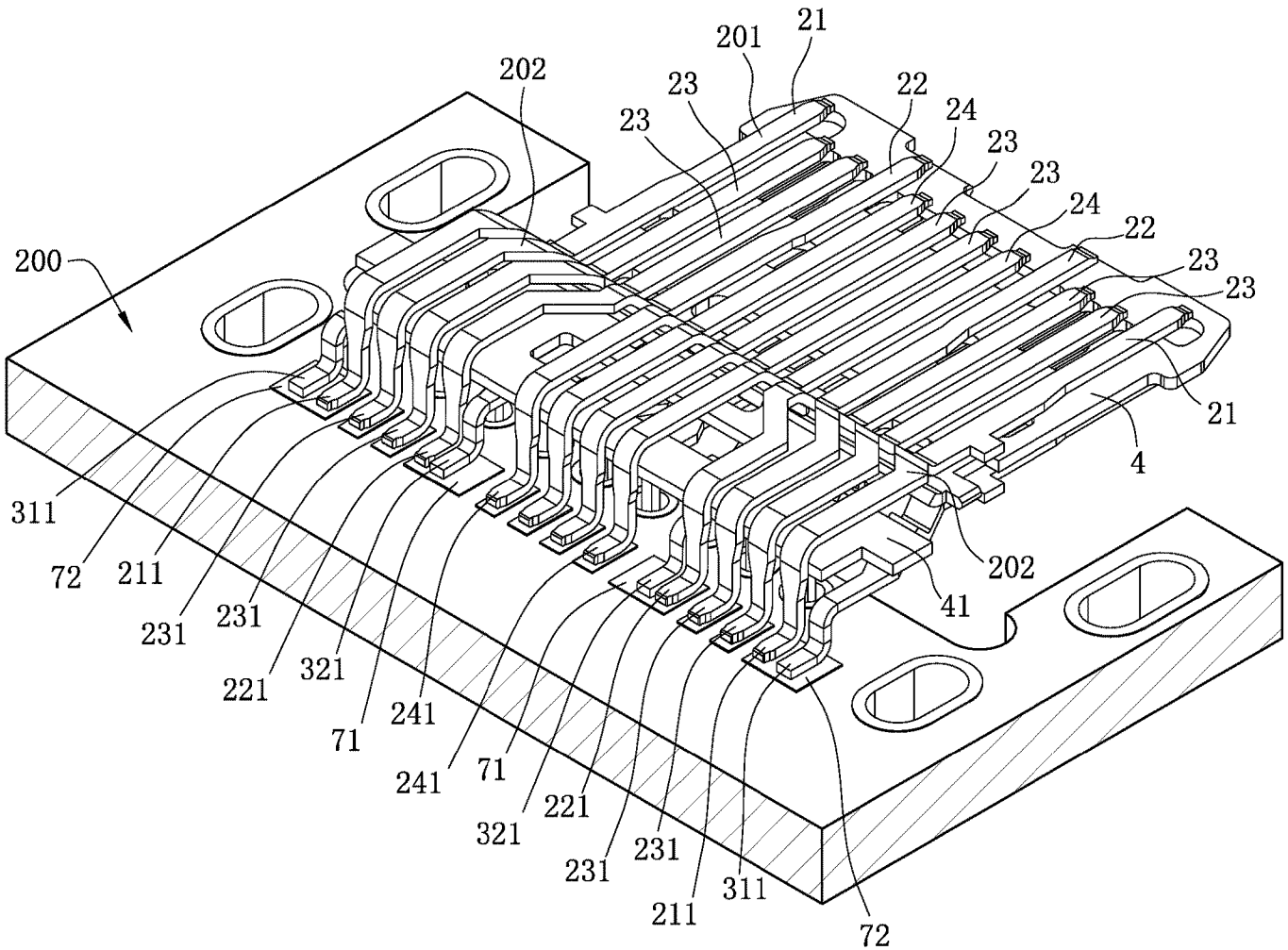
FIG. 6 is a schematic three-dimensional view of FIG. 5 showing a connection between a first and second terminal groups and the circuit board.

Referring to FIGS. 1, 4 and 6, the first terminal group 2 has multiple first terminals 20. The multiple first terminals 20 are sequentially arranged at the insulating body 1 in the left-right direction. The multiple first terminals 20 are respectively and sequentially arranged as grounding terminal, signal terminal, signal terminal, power terminal, reserved terminal, signal terminal, signal terminal, reserved terminal, power terminal, signal terminal, signal terminal and grounding terminal. That is, the multiple first terminals 20 includes two first ground terminals 21, two first power terminals 22, three pairs of first signal terminals 23 and two first reserved terminals 24. Two first terminals 20 which are arranged adjacent to each other and used for transmitting a differential signal are a pair of first signal terminals 23. The two pairs of first signal terminals 23 are high-speed differential signal terminals disposed at the left side and the right side of the insulating body 1. The other pair is low-speed differential signal terminals disposed in the middle of the insulating body 1. That is, the two first ground terminals 21, the two first power terminals 22 and the two pairs of first signal terminals 23 as the high-speed differential signal terminals are respectively arranged at the insulating body 1 in a bilaterally symmetric manner. Each of the first terminals 20 has a first contact portion 201 disposed at the first surface 121 and a first leg exposed out of the base 11, and all the first legs in the first terminal group 2 are arranged in a row in the left-right direction. The first legs of the first ground terminals 21 are defined as first grounding legs 211, the first legs of the first power terminals 22 are defined as first power legs 221, the first legs of the first signal terminals 23 are defined as first signal legs 231, and the first legs of the first reserved terminals 24 are defined as first reserved legs 241. In the present embodiment, the first grounding legs 211, the first power legs 221, the first signal legs 231 and the first reserved legs 241 are arranged in a row in the left-right direction and are respectively a surface soldering leg. The first ground terminals 21, the first power terminals 22 and the first signal terminals 23 as the high-speed differential signal terminals respectively have a first deflection portion 202 between the first contact portion 201 and the first leg, so that the first grounding legs 211, the first power legs 221 and the first signal legs 231 disposed at the same side of the insulating body 1 are deflected outward relative to the corresponding first contact portions 201.

Figure 2:
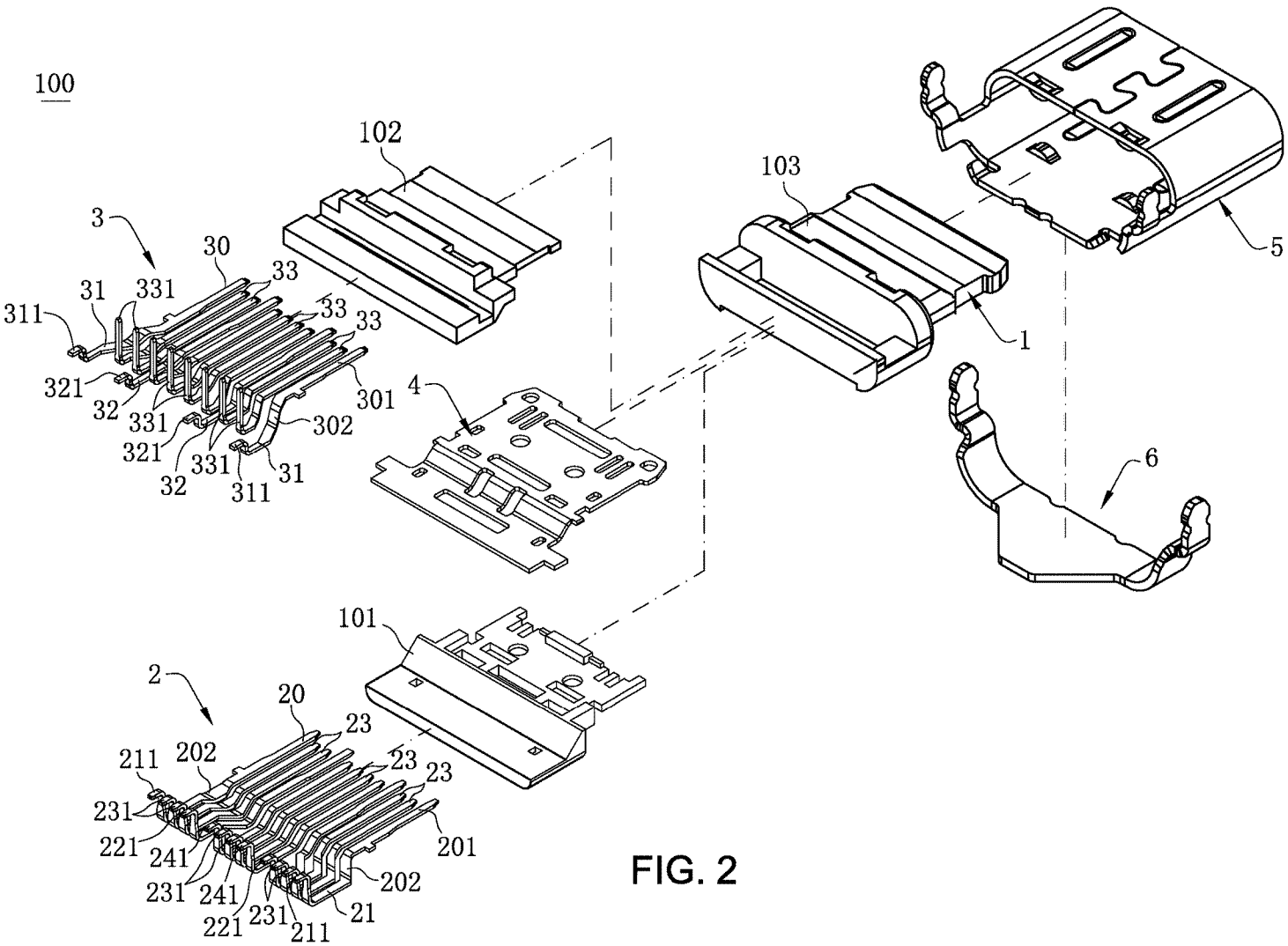
FIG. 2 is a schematic three-dimensional exploded view of FIG. 1 from another angle.

Referring to FIGS. 1, 2 and 4, the second terminal group 3 has multiple second terminals 30. The multiple second terminals 30 are sequentially arranged at the insulating body 1 in the left-right direction. The multiple second terminals 30 are respectively and sequentially arranged as grounding terminal, signal terminal, signal terminal, power terminal, reserved terminal, signal terminal, signal terminal, signal terminal, reserved terminal, power terminal, signal terminal, signal terminal and grounding terminal. That is, the multiple second terminals 30 include two second ground terminals 31, two second power terminals 32, three pairs of second signal terminals 33 and two second reserved terminals 34. Two second terminals 30 which are arranged adjacent to each other and used for transmitting a differential signal are a pair. The two pairs of second signal terminals 33 are high-speed differential signal terminals disposed at the left side and the right side of the insulating body 1. The other pair is low-speed differential signal terminals disposed in the middle of the insulating body 1. That is, the two second ground terminals 31, the two second power terminals 32 and the two pairs of second signal terminals 33 as the high-speed differential signal terminals are respectively arranged at the insulating body 1 in a bilaterally symmetric manner. Each of the second terminals 30 has a second contact portion 301 disposed at the second surface 122 and a second leg exposed out of the base 11, and the multiple second legs are arranged in two rows in the front-rear direction. The second legs in one row are surface soldering legs and are disposed in a same row with the multiple first legs, and the second legs in the other row are perforated legs. The second legs of the second ground terminals 31 are defined as second grounding legs 311, the second legs of the second power terminals 32 are defined as second power legs 321, and the second legs of the second signal terminals 33 are defined as second signal legs 331. In the present embodiment, the second grounding legs 311 and the second power legs 321 are arranged in a row in the left-right direction, the second signal legs 331 are arranged in another row in the left-right direction, both the second grounding legs 311 and the second power legs 321 are surface soldering legs, and the remaining second legs (not shown) are perforated legs. The second ground terminals 31, the second power terminals 32 and the second signal terminals 33 as the high-speed differential signal terminals respectively have a second deflection portion 302 between the second contact portion 301 and the second leg, so that the second grounding legs 311, the second power legs 321 and the second signal legs 331 disposed at the same side of the insulating body 1 are deflected outwards relative to the second contact portion 301 in the left-right direction.

Referring to FIGS. 1, 4 and 6, transmission specifications of multiple first contact portions 201 are in conformity with the transmission specifications of multiple second contact portions 301, and the multiple first contact portions 201 and the multiple second contact portions 301 are in 180-degree symmetry about the center point of the tongue 12. That is, a contact area where the electrical connector 100 mates with a mating electrical connector (not shown) conforms to the universal serial bus (USB) type-C specification. The first grounding legs 211, the second grounding legs 311, the first power legs 221, the second power legs 321, the first signal legs 231 and the second signal legs 331 are arranged in a row in the left-right direction. The second signal legs 331 are correspondingly disposed in front of the first signal legs 231, and the second signal legs 331 and the first signal legs 231 are arranged at intervals in the front-rear direction. At the left side/right side of the insulating body 1, only one pair of the first signal legs 231 are provided between the second grounding legs 311 and the second power legs 321 at the corresponding side, and between the first grounding legs 211 and the first power legs 221 at the corresponding side, i.e. the second grounding legs 311 and the second power legs 321 at the same side of the insulating body 1 are provided with only one pair of the first signal legs 231 therebetween, no additional one or more of the first signal legs 231 or the second signal legs 331 are interposed, but other types of legs such as the power legs and the grounding legs can be interposed; the first grounding legs 211 and the first power legs 221 at that side are disposed between the second grounding legs 311 and the second power legs 321 at that side, the first grounding legs 211 and the second grounding legs 311 are arranged adjacent to each other, and the first power legs 221 and the second power legs 321 are arranged adjacent to each other. At the left side/right side of the insulating body 1, the first reserved legs 241 and the first power legs 221 are disposed at two opposite sides of the second power legs 321, and a space between the first reserved legs 241 and the second power legs 321 is greater than the space between the first power legs 221 and the first signal legs 231 adjacent thereto.

Referring to FIGS. 1, 4 and 6, the metal shell 5 is of a cylindrical structure formed by stamping, bending and encircling a metal plate. The insulating body 1 is correspondingly received in the metal shell 5, and a mating space 51 is formed between the tongue 12 and the metal shell 5 and used for receiving the mating electrical connector (not shown). Two sides of the shielding sheet 4 respectively extend out of the base 11 to form a grounding sheet 41. The grounding sheets 41 contact an inner wall of the metal shell 5, so as to form a grounding path. Therefore, the shielding sheet 4 has no need of additionally arranging a grounding leg to be soldered with the circuit board 200. The metal fixing member 6 is generally in a shape of "U" and is engaged outside the metal shell 5 and connected with the circuit board 200, so that the electrical connector 100 is firmly connected with the circuit board 200.

Referring to FIG. 5 and FIG. 6, the circuit board 200 includes multiple connection points 7. The multiple connection points 7 are arranged in two rows in the front-rear direction and used for being connected with multiple first legs and multiple second legs. The multiple connection points 7 include two first solder pads 71 and two second solder pads 72. The first power legs 221 and the second power legs 321 disposed at the same side of the insulating body 1 are connected with the same one of the first solder pads 71, the first grounding legs 211 and the second grounding legs 311 disposed at the same side of the insulating body 1 are connected with the same one of the second solder pads 72, so that the first grounding legs 211 and the second grounding legs 311 of the same type and the first power legs 221 and the second power legs 321 of the same type can be arranged adjacent to each other, two legs of the same type can be close to each other and can have a small space, thereby reducing the overall size of the electrical connector 100, and further correspondingly reducing the number of the connection points 7 on the circuit board 200 and circuits (not shown) correspondingly connected with the connection points 7.

Figure 7:
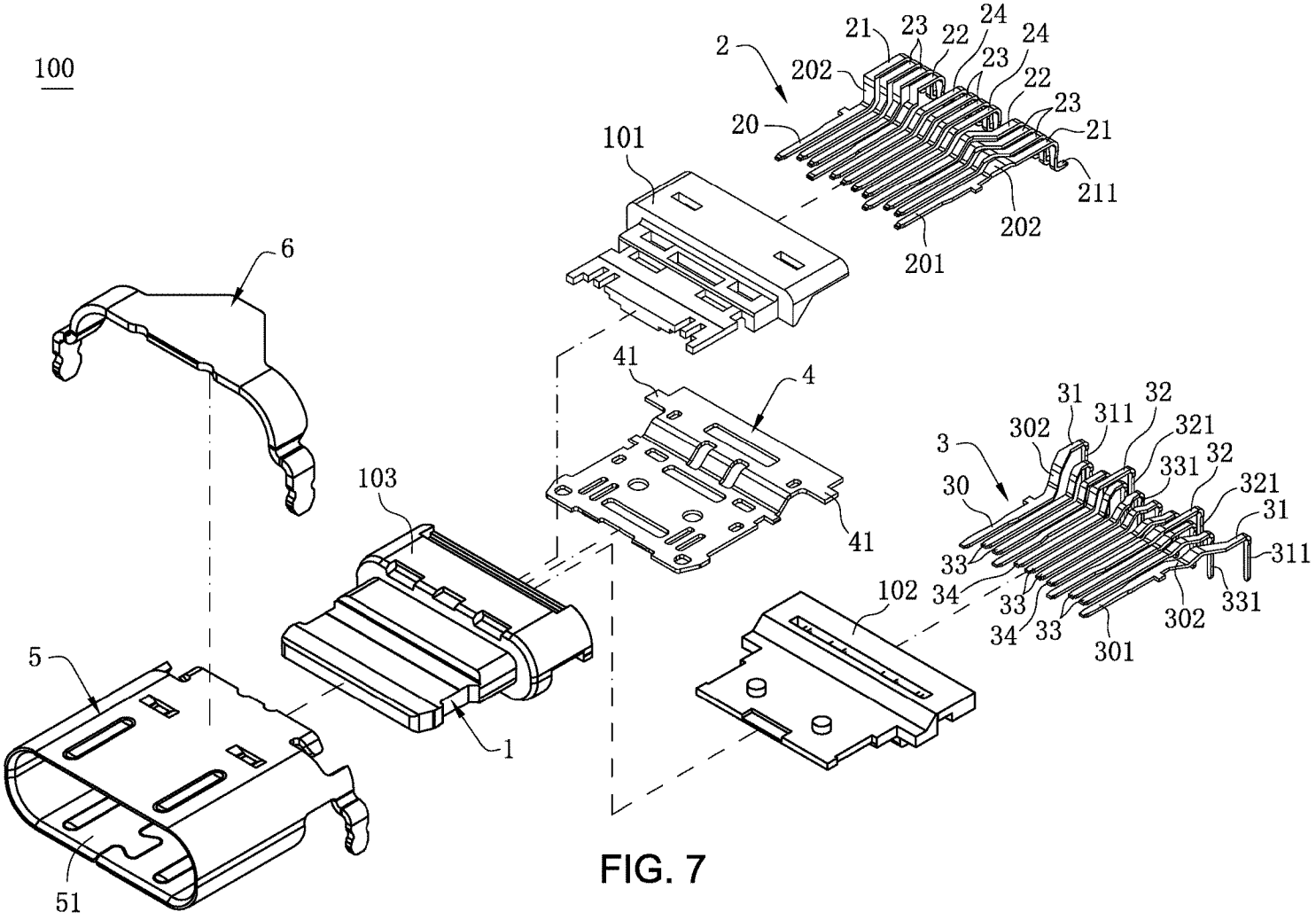
FIG. 7 is a schematic three-dimensional exploded view of an electrical connector according to a second embodiment of the present invention.
Figure 8:
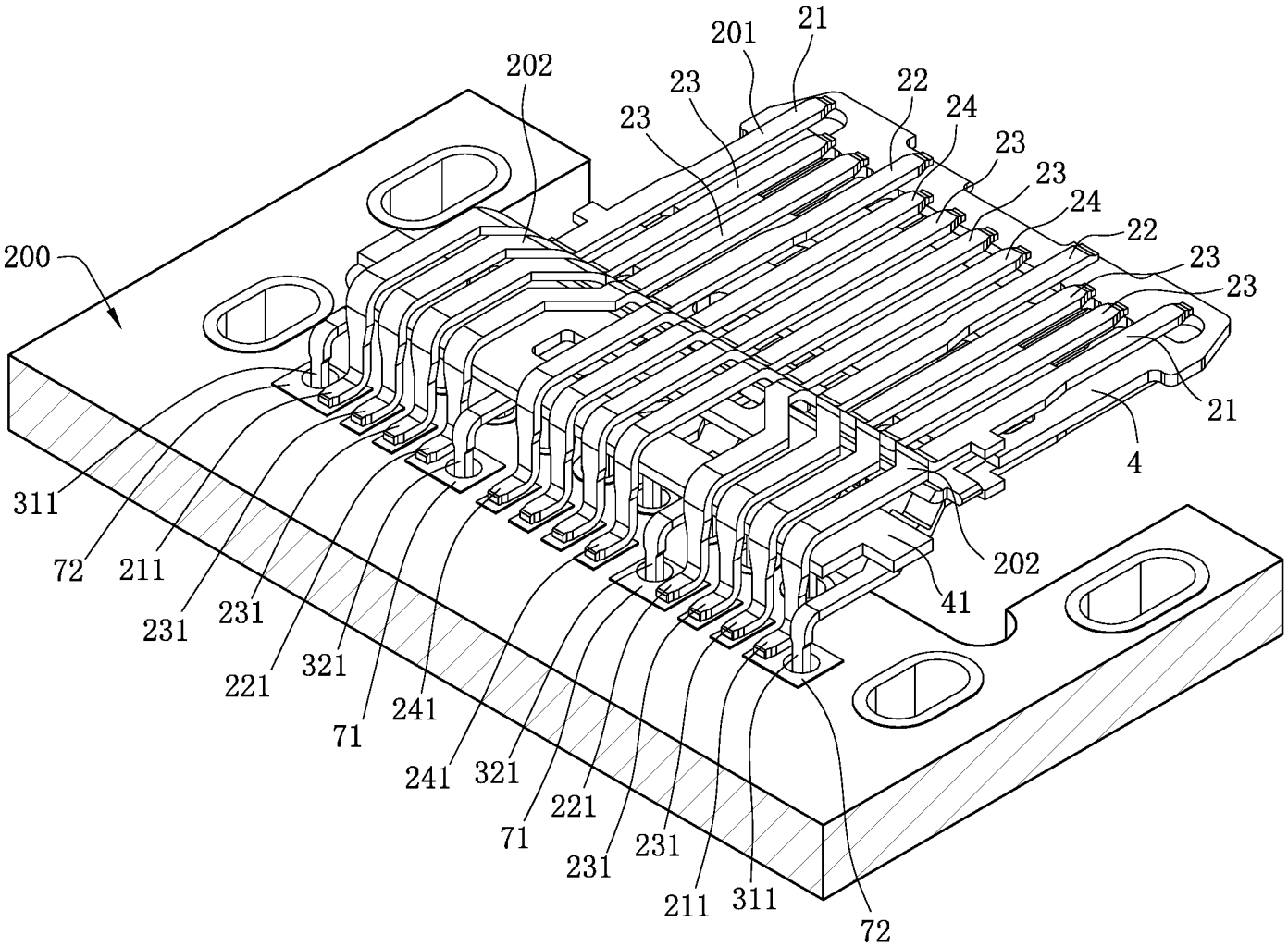
FIG. 8 is a schematic three-dimensional view of FIG. 7, where a first and second terminal groups are connected to a circuit board.

FIG. 7 and FIG. 8 show the second embodiment of the electric electrical connector 100 according to the present invention. In the present embodiment, a majority of structures is similar to that of the first embodiment and is not repeated here. The second embodiment differs from the first embodiment in that: multiple second legs are respectively perforated legs and are arranged in two rows in the front-rear direction. The second legs in one row are disposed in the same row with multiple first legs. That is, in the present embodiment, both the second grounding legs 311 and the second power legs 321 are perforated legs and are disposed in the same row with the first grounding legs 211, the first power legs 221 and the first signal legs 231 in the left-right direction, and the first solder pads 71 and the second solder pads 72 are correspondingly provided with through holes running through the circuit board 200.

In summary, the electrical connector according to certain embodiments of the present invention has the following beneficial advantages:

1. The second power legs 321 and the second grounding legs 311 in the second terminal group 3 and the first signal legs 231 in the first terminal groups 2 are arranged in a row, and the second power legs 321 and the second grounding legs 311 are provided with only one pair of first signal legs 231 therebetween, so that some legs in the first terminal group 2 and the second terminal group 3 can be integrally arranged in one row, and the number of the rows of the legs in the first terminal group 2 and the second terminal group 3 is reduced, thereby shortening the length of the first terminals 20 and the length of part of the second terminals 30, reducing the impedance of the first terminals 20 and the impedance of part of the second terminals 30, achieving relatively good high frequency performance of the electrical connector 100, and further shortening the overall length of the electrical connector 100.

2. The first grounding legs 211 and the second grounding legs 311 are arranged adjacent to each other, the first power legs 221 and the second power legs 321 are arranged adjacent to each other, the first power legs 221 and the second power legs 321 disposed at the same side of the insulating body 1 are connected with the same first solder pads 71, and the first grounding legs 211 and the second grounding legs 311 disposed at the same side of the insulating body 1 are connected with the same second solder pads 72, so that the first grounding legs 211 and the second grounding legs 311 of the same type and the first power legs 221 and the second power legs 321 of the same type can be arranged adjacent to each other, two legs of the same type can be close to each other and can have a small space, thereby reducing the overall size of the electrical connector 100, and further correspondingly reducing the number of the connection points 7 on the circuit board 200 and circuits (not shown) correspondingly connected with the connection points 7.

3. Two sides of the shielding sheet 4 respectively extend out of the base 11 to form a grounding sheet 41, the grounding sheets 41 contact the inner wall of the metal shell 5, so as to form a grounding path, therefore, the shielding sheet 4 has no need of additionally arranging a grounding leg to be soldered with the circuit board 200.

4. The first power legs 221 and the second power legs 321 are arranged adjacent to each other, at the left side/right side of the insulating body 1, the first reserved legs 241 and the first power legs 221 are disposed at two opposite sides of the second power legs 321, and the space between the first reserved legs 241 and the second power legs 321 is greater than the space between the first power legs 221 and the first signal legs 231 adjacent thereto, so that the first power terminals 22 and the second power terminals 32 can be arranged close to the first signal terminals 23, the first signal terminals 23 are shielded, and the high frequency performance is relatively good.

5. The first ground terminals 21, the first power terminals 22 and the first signal terminals 23 disposed at the same side of the insulating body 1 respectively have the first deflection portion 202, the second ground terminals 31 and the second power terminals 32 respectively have the second deflection portion 302, the first grounding legs 211, the second grounding legs 311, the first power legs 221, the second power legs 321 and the first signal legs 231 at the same side are respectively and relatively deflected outwards in the left-right direction, so that a leg of the first terminal group 2 has a sufficient space in the left-right direction to allow the second grounding legs 311 and the second power legs 321 to be disposed in the same row with the first legs.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body;

a first terminal group arranged at the insulating body, and comprising at least one pair of first signal terminals, each of the signal terminals having a first signal leg exposed out of the insulating body; and a second terminal group arranged at the insulating body, and comprising a ground terminal and a power terminal, the ground terminal of the second terminal group having a grounding leg exposed out of the insulating body, the power terminal of the second terminal group having a power leg exposed out of the insulating body, wherein the first signal leg, the grounding leg of the ground terminal of the second terminal group and the power leg of the power terminal of the second terminal group are arranged in a row, and the grounding leg of the ground terminal of the second terminal group and the power leg of the power terminal of the second terminal group are provided with only one pair of the first signal legs therebetween.

2. The electrical connector of claim 1, wherein the first terminal group further comprises a ground terminal and a power terminal, the ground terminal of the first terminal group has a grounding leg exposed out of the insulating body, and the power terminal of the first terminal group has a power leg exposed out of the insulating body.

3. The electrical connector of claim 2, wherein the electrical connector is used for being installed at a circuit board, the circuit board has at least one solder pad, the power leg of the power terminal of the first terminal group and the power leg of the power terminal of the second terminal group are arranged adjacent to each other, and the power leg of the power terminal of the first terminal group and the power leg of the power terminal of the second terminal group are connected with a same one of the at least one solder pad.

4. The electrical connector of claim 3, wherein both the power leg of the power terminal of the first terminal group and the power leg of the power terminal of the second terminal group are surface soldering legs.

5. The electrical connector of claim 3, wherein the power leg of the power terminal of the first terminal group is a surface soldering leg, and the power leg of the power terminal of the second terminal group is a perforated leg.

6. The electrical connector of claim 2, wherein the grounding leg of the ground terminal of the first terminal group, the grounding leg of the ground terminal of the second terminal group, the power leg of the power terminal of the first terminal group, the power leg of the power terminal of the second terminal group and the first signal legs are arranged in a row.

7. The electrical connector of claim 2, wherein the first signal legs are arranged between the grounding leg of the ground terminal of the first terminal group and the power leg of the power terminal of the first terminal group.

8. The electrical connector of claim 7, wherein the grounding leg of the ground terminal of the first terminal group and the power leg of the power terminal of the first terminal group are disposed between the grounding leg of the ground terminal of the second terminal group and the power leg of the power terminal of the second terminal group.

9. The electrical connector of claim 8, wherein the first terminal group further comprises a reserved terminal, the reserved terminal has a first reserved leg exposed out of the insulating body, the first reserved leg and the power leg of the power terminal of the first terminal group are disposed at two opposite sides of the power leg of the power terminal of the second terminal group, and a space between the first reserved leg and the power leg of the power terminal of the second terminal group is greater than a space between the power leg of the power terminal of the first terminal group and the first signal leg adjacent thereto.

10. The electrical connector of claim 2, wherein the electrical connector is used for being installed at a circuit board, the circuit board has at least one solder pad, the grounding leg of the ground terminal of the first terminal group and the grounding leg of the ground terminal of the second terminal group are arranged adjacent to each other, and the grounding leg of the ground terminal of the first terminal group and the grounding leg of the ground terminal of the second terminal group are connected with a same one of the at least one solder pad.

11. The electrical connector of claim 10, wherein both the grounding leg of the ground terminal of the first terminal group and the grounding leg of the ground terminal of the second terminal group are surface soldering legs.

12. The electrical connector of claim 10, wherein the grounding leg of the ground terminal of the first terminal group is a surface soldering leg, and the grounding leg of the ground terminal of the second terminal group is a perforated leg.

13. The electrical connector of claim 1, wherein the insulating body has a base and a tongue arranged in front of the base, the tongue has a first surface and a second surface disposed opposite to each other, each of the first signal terminals has a first contact portion exposed at the first surface, and each of the ground terminal of the second terminal group and the power terminal of the second terminal group has a second contact portion exposed at the second surface.

14. The electrical connector of claim 13, further comprising:

a shielding sheet disposed between the first terminal group and the second terminal group; and a metal shell disposed on the periphery of the insulating body, wherein at least one side of the shielding sheet is projected out of the base to form a grounding sheet, and the grounding sheet contacts the metal shell.

15. The electrical connector of claim 1, wherein the second terminal group further comprises at least one pair of second signal terminals, each of the second signal terminals has a second signal leg exposed out of the insulating body, the second signal legs are arranged in a row, and each of the second signal legs and corresponding one of the first signal legs are arranged at an interval in a front-rear direction.

16. The electrical connector of claim 2, wherein the first terminal group comprises two ground terminals and two power terminals, the second terminal group comprises two ground terminals and two power terminals, two pairs of the first signal terminals are provided, and the ground terminals of the first terminal group, the ground terminals of the second terminal group, the power terminals of the first terminal group, the power terminals of the second terminal group and the first signal terminals are arranged at two sides of the insulating body in a bilaterally symmetric manner respectively.

17. The electrical connector of claim 16, wherein the ground terminal of the first terminal group, the ground terminal of the second terminal group, the power terminal of the first terminal group, the power terminal of the second terminal group and the first signal terminals disposed at a same side of the insulating body respectively have a deflection portion, so that the ground terminal of the first terminal group, the ground terminal of the second terminal group, the power terminal of the first terminal group, the power terminal of the second terminal group and the first signal legs at the same side are deflected outward in a left-right direction.

18. The electrical connector of claim 1, wherein the first terminal group comprises a plurality of the first legs exposed out of the insulating body, the first legs are surface soldering legs and are arranged in a row, the second terminal group comprises a plurality of the second legs exposed out of the insulating body, the second legs are arranged in two rows in a front-rear direction, the second legs in one of the two rows are surface soldering legs and are disposed in a same row with the first legs, and the second legs in the other one of the two rows are perforated legs.

19. The electrical connector of claim 1, wherein the first terminal group comprises a plurality of the first legs exposed out of the insulating body, the first legs are surface soldering legs and are arranged in a row, the second terminal group comprises a plurality of the second legs exposed out of the insulating body, the second legs are all perforated legs and are arranged in two rows in a front-rear direction, the second legs in one of the two rows are disposed in a same row with the first legs.

20. The electrical connector of claim 1, wherein the insulating body has a base and a tongue arranged in front of the base, the tongue has a first surface and a second surface disposed opposite to each other, the first terminal group is provided with a plurality of first contact portions disposed at the first surface, the second terminal group is provided with a plurality of second contact portions disposed at the second surface, each of the first and second contact portions are respectively arranged sequentially with specifications of grounding terminal, signal terminal, signal terminal, power terminal, reserved terminal, signal terminal, signal terminal, reserved terminal, power terminal, signal terminal, signal terminal and grounding terminal, and the first contact portions and the second contact portions are in 180-degree symmetry about a center point of the tongue.

* * * * *